US005406601A

United States Patent [19]

Hinderer et al.

[11] Patent Number: 5,406,601

[45] Date of Patent: Apr. 11, 1995

[54] TRANSPORT AND STORAGE CASK FOR SPENT NUCLEAR FUEL

[75] Inventors: James R. Hinderer; Daniel L. Mensink, both of Lynchburg, Va.; Thomas E. Rollman, Salem, Oreg.

[73] Assignee: The Babcock & Wilcox Company, New Orlenas, La.

[21] Appl. No.: 236,308

[22] Filed: May 2, 1994

[51] Int. Cl.[6] ..... G21F 5/008

[52] U.S. Cl. ..... 376/272; 250/507.1

[58] Field of Search ..... 376/272; 250/506.1, 250/507.1

[56] References Cited

U.S. PATENT DOCUMENTS 3,466,445 9/1969 Schlies ..... 376/272

4,292,528 9/1981 Shaffer et al. ..... 376/272

*Primary Examiner*—Daniel D. Wasil

*Attorney, Agent, or Firm*—Robert J. Edwards; D. Neil LaHaye

[57] ABSTRACT

A transport and storage cask for spent nuclear fuel. A cask body having one open end receives a basket in such a manner so as to maintain a steady state gap between the cask body and basket. Centering keys on the cask body and basket provide the centering function. For ease of manufacture, the basket is formed from multiple layers of rowed carbon steel plates that have complementary grooves in their mating surfaces to form fuel cell channels when the plates are assembled together. Bands are attached together around the plates at narrowed diameter portions on the plates to hold the plates in their assembled position. The gap between the basket and cask body allows the cask to withstand a fire transient without transmitting heat from the fire into the basket.

3 Claims, 2 Drawing Sheets

TRANSPORT AND STORAGE CASK FOR SPENT NUCLEAR FUEL

BACKGROUND OF THE INVENTION

1. Field of the Invention

The invention is generally related to the transport and storage of radioactive material and particularly to a cask that can be used for transporting or storing spent nuclear fuel.

2. General Background

Nuclear reactors require periodic replacement of the nuclear fuel. Fuel removed from reactors in naval vessels and some land based commercial reactors must be transported to a storage site. In some instances, there may be storage room at the site of the land based reactor. The United States Nuclear Regulatory Commission sets standards that must be met for casks that are used to transport or store spent nuclear fuel. Due to the different conditions that may be encountered during transport and static storage, separate standards are set for transport casks and for storage casks. These standards are respectively set forth in 10 CFR 71 and 10 CFR 72. Shipping casks must be able to withstand shock loads during transport while storage casks must be able to withstand temperature transients such as a fire external to the cask without transmitting additional heat to the inside of the cask. As a result, it is common to have separate casks for transport and storage. This presents the need for additional work in the form of transferring the fuel from one cask to another once the shipment has arrived at the storage site. If there is not an immediate need for reuse of the transport cask, then the transport cask which has a radioactive interior after use must also be stored until it is needed again.

SUMMARY OF THE INVENTION

The present invention addresses the above problem in a straightforward manner. What is provided is a cask that can be used for both transport and storage of spent nuclear fuel. The cask body and basket are designed such that there is a gap between the cask body and basket. The basket is formed from multiple layers of rowed plates that cooperate with the cask body to provide the required radiation shielding, thermal, and structural requirements of 10 CFR 71 and 10 CFR 72. The plates have complementary shapes and partial hex grooves machined therein such that complete channels for the fuel cells are formed when the plates are mated for insertion into the cask body. The plates have narrowed diameter sections and are held together by bands around the circumference of the plates at these sections. Locating keys received in grooves between the plates extend the entire axial length of the basket to hold the plates in alignment during assembly and to block radiation leakage across the vertical gaps between the plates. Centering keys are provided at the upper and lower ends of the basket and cask body to provide a consistent gap between the basket and cask body. The gap expands during a fire due to thermal expansion of the cask body prior to thermal expansion of the basket and thus does not allow conduction of the external heat into the basket and fuel during an external transient temperature rise.

BRIEF DESCRIPTION OF THE DRAWINGS

For a further understanding of the nature and objects of the present invention reference should be had to the following description, taken in conjunction with the accompanying drawings, in which like parts are given like reference numerals, and wherein.

DETAILED DESCRIPTION OF THE PREFERRED EMBODIMENT

Figure 1:
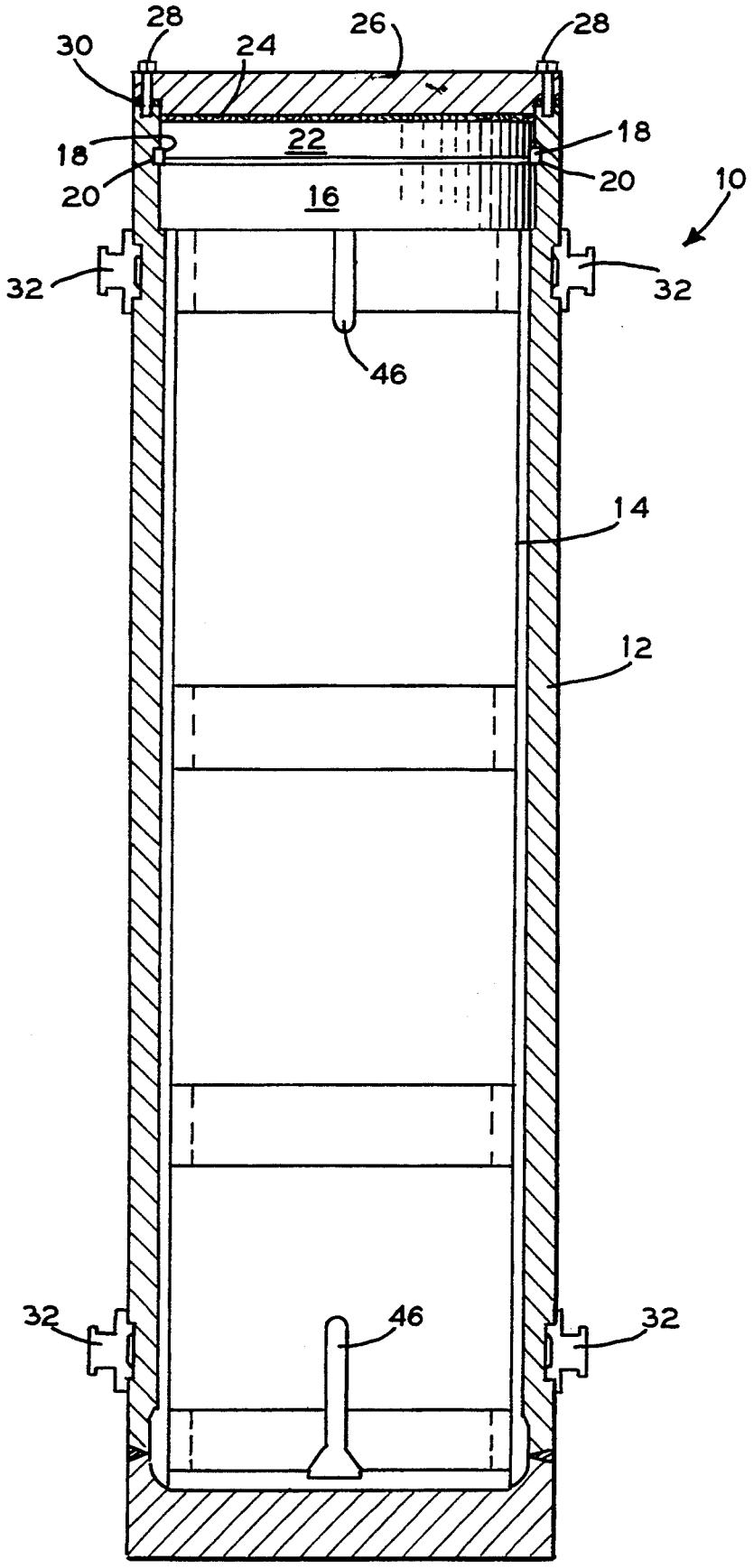
FIG. 1 is a longitudinal section view of the invention.

Referring to the drawings, it is seen in FIG. 1 that the invention is generally indicated by the numeral 10. Transport and storage cask 10 is generally comprised of cask body 12, and basket 14.

Cask body 12 is formed from stainless steel in the preferred embodiment. As seen in FIG. 1, cask body 12 is closed at one end and provided with suitable shield and seal means at the opposite end. The interior diameter of the upper end of cask body 12 is slightly larger than the remainder of the interior of cask body 12 to receive shield plug 16. This helps to prevent radiation leakage through the upper end. Shear ring segments 18 are positioned on top of shield plug 16 and are received in a notch 20 provided around the inner circumference of cask body 12. Shear ring segments 18 prevent operating and accident loads from being transferred to inner lid 22 which is positioned immediately above shield plug 16. Inner lid 22 is provided with a groove around its lower end necessary to fit around shear ring segments 18. Inner lid 22 may be seal welded to the inner circumference of cask body 12 as indicated at numeral 24. Outer lid 26 is fastened around its circumference to cask body 12 by bolts or studs 28. A replaceable metal O-ring 30 may be placed between outer lid 26 and the end of cask body 12 to provide an outer seal. Lifting bales 32 are provided as necessary on the exterior of cask body 12.

Figure 2:
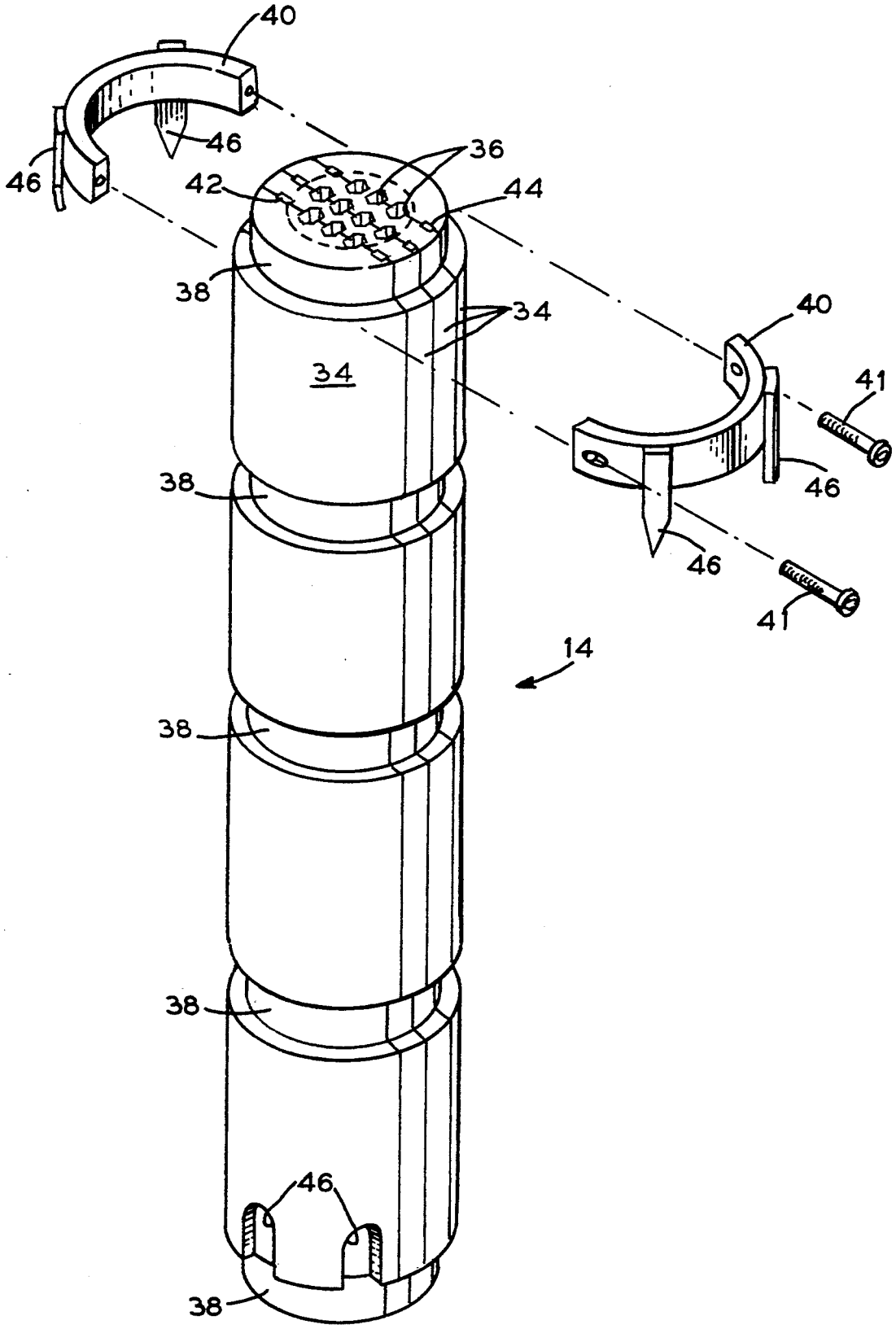
FIG. 2 is a perspective view of the basket of the invention.

Basket 14, best seen in FIG. 2, is formed from multiple layers of rowed carbon steel plates 34. Plates 34 have complementary shapes and partial hex grooves machined therein such that complete channels 36 for the fuel cells are formed when plates 34 are mated for insertion into cask body 12. Channels 36 are illustrated as being hexagonal but may be of any suitable shape depending on the material to be transported or stored. Plates 34 have a narrowed diameter 38 at each end and at intervals spaced apart along their length. Bands 40 are attached to each other by bolts 41 around plates 34 at each narrowed circumference point 38 to hold plates 34 in their assembled positions. The flat mating surfaces of plates 34 are machined to provide a close fit to prevent radiation leakage between plates 34. However, plates 34 may also each be provided with complementary grooves along their length to form a channel 42 between each plate sized to receive a locating key 44 that extends the full length of the plates. Each locating key 44 serves the dual purpose of holding the plates in alignment during assembly and blocking radiation from leaking between the mating surfaces at the plate junctions.

Means for centering basket 14 in cask body 12 to maintain a steady state gap between the interior of cask body 12 and basket 14 are provided on cask body 12 and basket 14 in the form of centering keys 46. In the preferred embodiment, female key ways are provided at the lower end of basket that are designed to receive male keys on the inside lower end of cask body 12 while male keys are provided at the upper end of basket 14 and female key ways are provided at the upper end of cask body 12. The centering keys at the lower end of cask body 12 and basket 14 are preferably sized such that they engage basket 14 during installation in cask body 12 before the centering keys at the upper end engage. This provides for automatic location of the upper centering keys.

In use, spent nuclear fuel is loaded into fuel cell channels 36 and shield plug 16, inner lid 22, and outer lid 26 are installed. Basket 14 and cask body 12 both undergo thermal expansion due to thermal radiation from the spent fuel that results in the gap between them remaining constant. During a fire transient, cask body 12 will absorb heat from the fire and undergo thermal expansion. However, due to the gap between cask body 12 and basket 14, little or none of the absorbed heat will be transferred across the gap and the gap will enlarge due to thermal expansion of cask body 12. Although the elevated temperature of cask body 12 from the fire precludes radiation of waste heat from the spent fuel, it has been determined that the peak fuel temperature will not occur until over twelve hours after the onset of the fire transient. The present invention thus provides a storage cask for spent nuclear fuel that is capable of withstanding normal operating and accident loads during transportation and normally expected fire transients.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A transport and storage cask for spent nuclear fuel, comprising:

a. a cask body having one open end;

b. a basket formed from multiple layers of rowed plates that have complementary notches therein along the length of the plates such that the notches form fuel cell channels when the plates are assembled adjacent each other, said basket sized to be received in said cask body;

c. centering keys on said cask body and said basket that maintain a gap between the inner surface of said cask body and the outer surface of said basket; and d. means for shielding and sealing the open end of said cask body.

2. The transport and storage cask of claim 1, further comprising locating keys that extend the length of said basket and are received in notches in the mating surfaces of the plates forming said basket.

3. The transport and storage cask of claim 1, wherein said means for shielding and sealing the open end of said cask body comprises:

a. a shield plug received in the open end immediately above said basket;

b. a shear ring installed in said cask body between said shield plug and the open end of said cask body;

c. an inner lid seal welded in said cask body between said shear ring and the open end of said cask body; and d. an outer lid fastened to the open end of said cask body.

* * * * *